US008667919B2

(12) United States Patent
Higby

(10) Patent No.: US 8,667,919 B2
(45) Date of Patent: Mar. 11, 2014

(54) BOAT ANCHOR

(76) Inventor: Adam Higby, Deer Park, WA (US)

( * ) Notice: Subject to any disclaimer, the term of this patent is extended or adjusted under 35 U.S.C. 154(b) by 93 days.

(21) Appl. No.: 13/449,511

(22) Filed: Apr. 18, 2012

(65) Prior Publication Data

US 2013/0276690 A1 Oct. 24, 2013

(51) Int. Cl.
*B63B 21/24* (2006.01)

(52) U.S. Cl.
USPC ..... 114/293; 114/294

(58) Field of Classification Search
USPC ..... 114/230.1, 230.13, 293, 294
See application file for complete search history.

(56) References Cited

U.S. PATENT DOCUMENTS

| | | | | | |
|---|---|---|---|---|---|
| 2,907,294 | A * | 10/1959 | Lawler | 114/230.1 |
| 5,499,591 | A * | 3/1996 | Chippas | 114/230.15 |
| 5,699,864 | A * | 12/1997 | Dvorak et al. | 173/91 |
| 7,637,222 | B1 * | 12/2009 | Keely | 114/230.17 |
| 2011/0041752 | A1 * | 2/2011 | LaCivita | 114/230.13 |

* cited by examiner

*Primary Examiner* — Stephen Avila
(74) *Attorney, Agent, or Firm* — Paine Hamblen, LLP

(57) ABSTRACT

A boat anchor is described and which includes a fixture, which is releasably secured to a cleat that is mounted on a boat; an adjustable arm moveably mounted to the fixture and which has a distal end; a channel member mounted on the distal end of the adjustable arm and which defines a passageway; and an elongated anchor rod which is received in the passageway and which further has a distal end which is operable to engage an underwater surface, which is located near the boat, and wherein the adjustable arm maintains the boat at a predetermined distance from the anchor rod.

27 Claims, 14 Drawing Sheets

BOAT ANCHOR

TECHNICAL FIELD

The present application relates to a boat anchor, and more specifically to a boat anchor which may be readily releasably attached to an existing boat cleat and which is affixed to a recreational boat or watercraft of conventional design, and which further provides a convenient means by which the boat may be securely anchored so as to prevent the movement of either the bow or the stern of the boat relative to the position of the boat anchor.

BACKGROUND OF THE INVENTION

Recreational boating has increased steadily in recent years. Recreational boats of various designs have been provided to meet the needs and assorted interests of various consumers. For example, recreational boats which include fishing boats; pontoon boats; speed boats; cruising motor yachts and the like have been developed to meet various consumers' interests and tastes. These recreational boats are varied in length, from as short as 10 to 15 feet, to as long as 60 or more feet. Further, these same recreational boats have a draft which may be measured in mere inches of water, to those which may draw as much as 5 to 7 feet of water as in the case of sailboats.

Small recreational boats for waterskiing, and similar water sports typically have lengths of less than 22 feet. Further, their shallow drafts allow these boats to be used in shallow water and many boating enthusiasts often find it desirable to "beach" the boats by finding a suitable sandy beach and then running the bow of the boat up onto the beach so as to temporarily secure it so that they may enjoy the beach during their day on the water. (Please see FIG. 4.)

Often in those circumstances where a boat has been "beached" onto a sandy outcropping for purposes of recreation, the incoming waves from the body of water which is adjacent to the beach often causes the boat to turn, either to the port or starboard side, thereby causing the boat to move to a position which is substantially parallel to the beach. (Please see FIG. 6) While typically this does not normally cause problems, in some circumstances this is undesirable because one or more other boats may be also "beached" close by. Therefore, a movement of a beached boat, sideways, may cause an undesirable collision with an adjacent beached boat, or further may cause the stern drive on the boat to be dragged needlessly through the underwater sediment found under or near the boat. When a beached boat twists or otherwise turns parallel to the beach, the skipper of the beached watercraft typically will go out into the water and then forcibly move the stern of the boat back to a position where it is substantially perpendicular to the beach, and away from any adjacent watercraft. The skipper of the watercraft may have to do this multiple times during several hours in order to rectify the undesirable movement of the boat.

It should be readily recognized that the movement of the boat may occur slowly over time or may further suddenly occur when, for example, a large wave approaches the beach and which is generated from a passing watercraft. In view of the size of the wave, the movement may be rather rapid and/or violent and if another boat is nearby, serious damage may result because of the collision of the two boats.

Heretofore, there has been no convenient means by which an owner of a boat or other watercraft could conveniently "beach" the watercraft or boat in a predetermined orientation and thereafter secure either the bow or the stern in a convenient manner so that it would not move, notwithstanding incoming waves or surf which may move against either the stern or bow and thereby causing it to turn the boat or watercraft to a position where it was substantially parallel to the beach without first placing at least one anchor in relatively deep water astern of the boat. (Please see FIG. 5). While this remedy has operated with some degree of success, it is often inconvenient, and still does not completely prevent movement of the boat caused by incoming waves or surf. While some skippers may deploy two anchors off of the stern, for example, this remedy increases the inconvenience of beaching the boat, and further requires the provisions of a second anchor. In view of the small size of such boats, the provision of a second anchor is usually undesirable because there typically is reduced storage space for such anchors on these same boats.

SUMMARY OF THE INVENTION

A first aspect of the present invention relates to a boat anchor which includes, a fixture which is releasably secured to a cleat that is mounted on a boat; an adjustable arm moveably mounted to the fixture, and which has a distal end; a channel member mounted on the distal end of the adjustable arm and which defines a passageway; and an elongated anchor rod which is received in the passageway, and which further has a distal end which is operable to engage an underwater surface which is located near the boat, and wherein the adjustable arm maintains the boat at a predetermined distance from the anchor rod.

Still another aspect of the present invention relates to a boat anchor which includes, a cleat mounted on a boat, and wherein the cleat has a central region which is secured to the boat, and further has individual, longitudinally oriented, and opposed cleat wings which extend laterally outwardly relative to the central region, and which are spaced from the boat, and wherein a passageway extends through the central region of the cleat, and wherein the cleat has opposite first and second surfaces; a first elongated support member having first, second and third apertures formed therein, and which is juxtaposed relative to the first surface of the cleat, and wherein the second aperture is substantially coaxially aligned with the passageway formed in the central region of the cleat; a second elongated support member having first, second and third apertures formed therein, and which is juxtaposed relative to the second surface of the cleat, and wherein the first, second and third apertures of the second elongated support member are substantially coaxially aligned relative to the first second and third apertures formed in the first elongated support member; first, second and third fasteners received through the coaxially aligned first, second and third coaxially aligned apertures formed in the respective first and second elongated support members, and wherein the second fastener is received through the passageway formed in the central region of the cleat, and wherein the respective fasteners releasably secure the first and second elongated support members to the cleat; a first member of an adjustable mounting assembly having a proximal end which is releasably secured to the first elongated support member by the second fastener, and which further has a second distal end which extends substantially laterally outwardly relative to the first elongated support member, and away from the cleat, and wherein an indexing member extends longitudinally outwardly relative to the distal end of the first member; a second member of an adjustable mounting assembly having a main body which has a proximal end which is releasably affixed to the second elongated support member by the second fastener, and an opposite distal end, and wherein the main body of the second member has a first leg which extends laterally outwardly relative to the second elongated support member, and which is substantially parallel relative to the first member of the adjustable mounting assembly, and a second leg which is substantially perpendicular to the first leg, and wherein a multiplicity of apertures are formed in a given longitudinally extending pattern along the second leg, and which are dimensioned to receive the indexing member therein; a U-shaped attachment member having a main body which is rotatably attached to the second member of the adjustable mounting assembly, and wherein the main body has a pair of spaced legs which extend normally outwardly relative to the second leg of the second member; an adjustable elongated arm having a proximal and a distal end, and wherein the proximal end is received between, and rotatably secured to, the spaced legs of the U-shaped attachment member, and wherein the adjustable arm is selectively angularly adjustable relative to the U-shaped adjustment member, and wherein the adjustable arm is moveable in multiple axes; a rotatable channel member mounted on the distal end of the adjustable arm, and which defines a passageway extending therethrough; and an elongated anchor rod having a main body with a proximal and a distal end, and which extends through the rotatable channel, and wherein the distal end is operable to engage an underwater surface which is located near the boat, and wherein the elongated anchor rod moves substantially freely though the passageway as defined by the rotatable channel member as the boat moves upwardly and downwardly in response to a movement of a body of water upon which the boat is floating, and wherein the adjustable arm maintains the boat at a predetermined distance from the anchor rod.

These and other aspects of the present invention will be discussed in greater detail hereinafter.

BRIEF DESCRIPTION OF THE DRAWINGS

The preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful laws [Art. I, Sec. 8].

Figure 1:
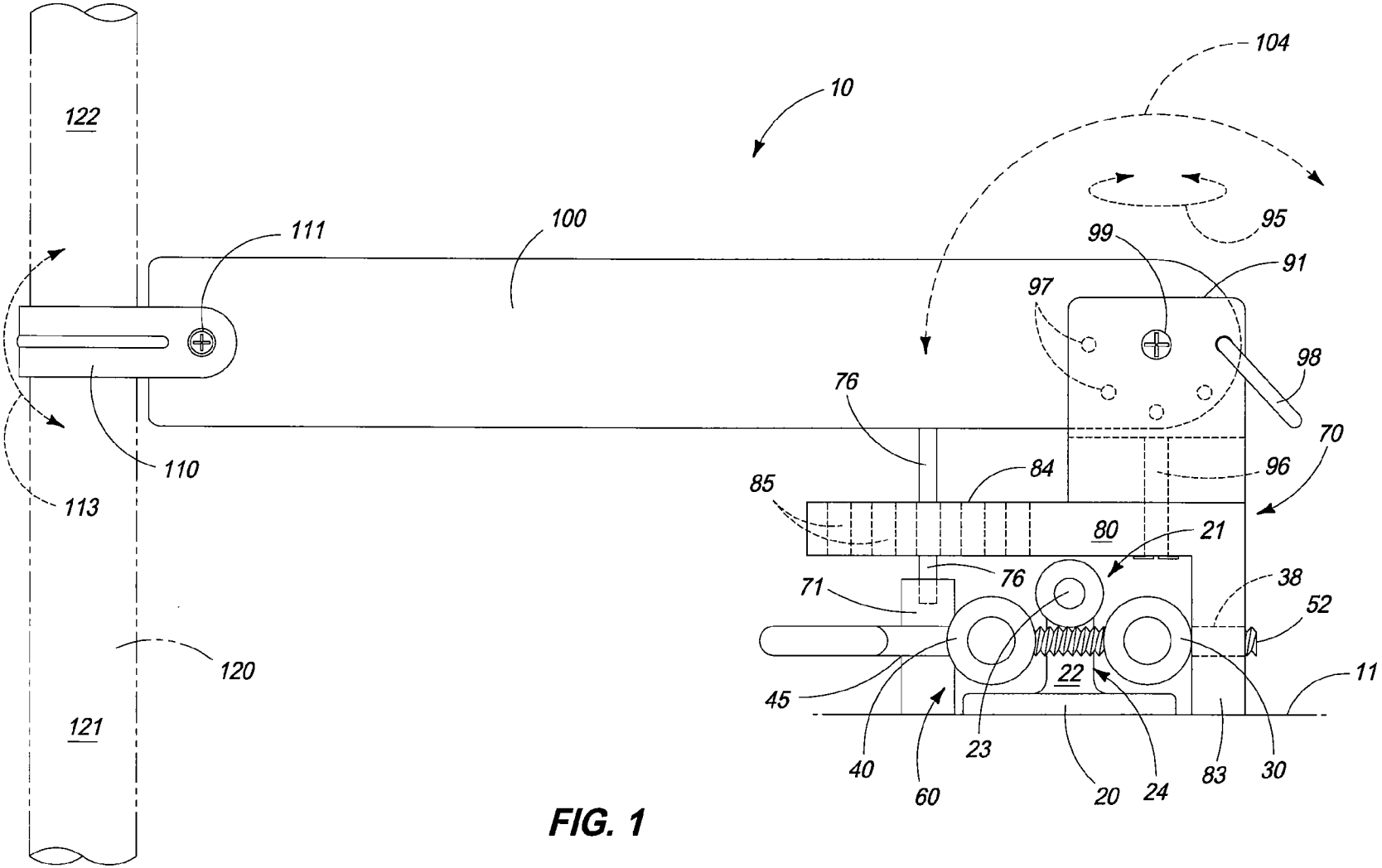
FIG. 1 is fragmentary, partial, transverse sectional, and side elevation view of the boat anchor of the present invention.
Figure 2:
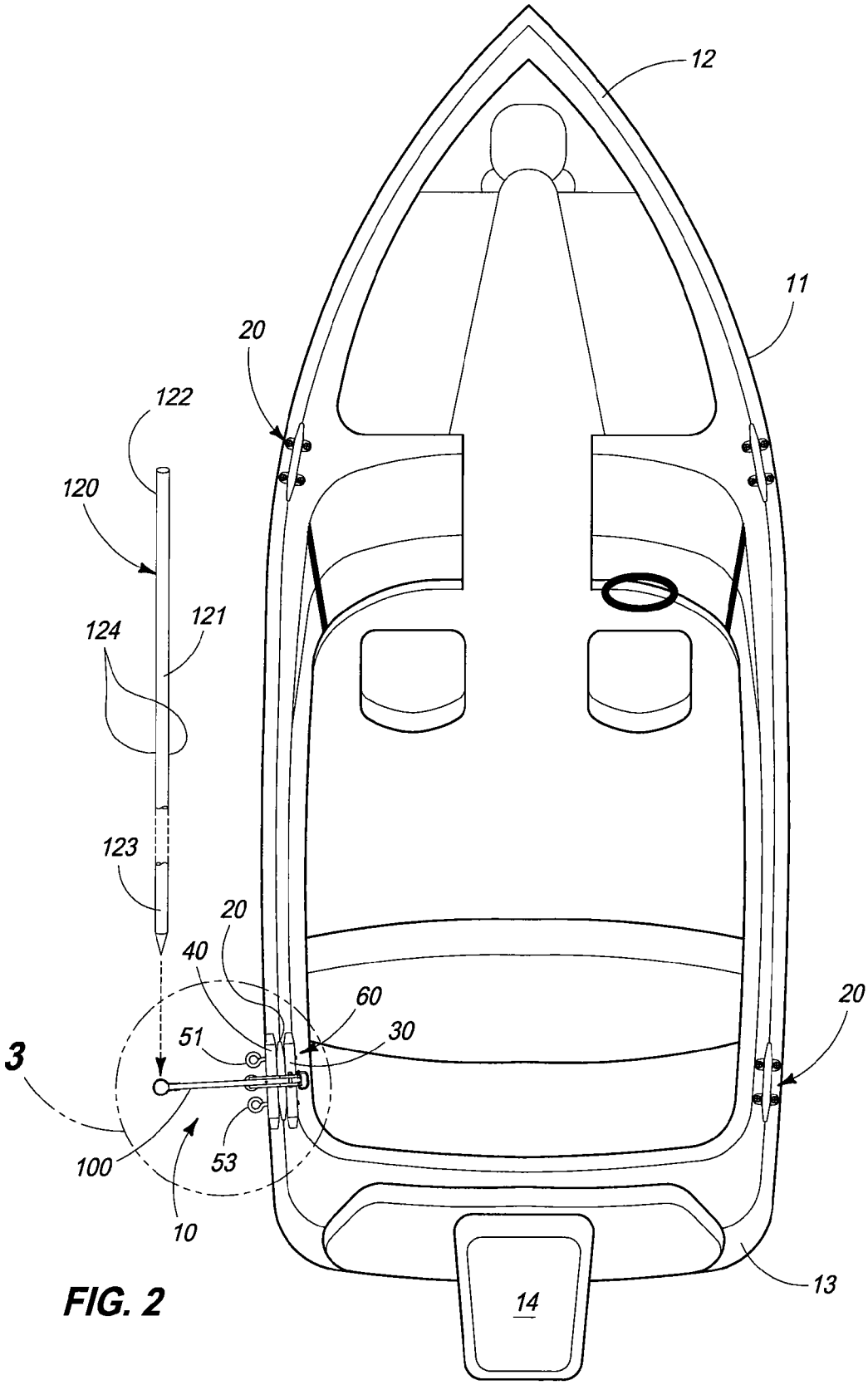
FIG. 2 is a top plan view of the present invention mounted on a boat of conventional design.
Figure 3:
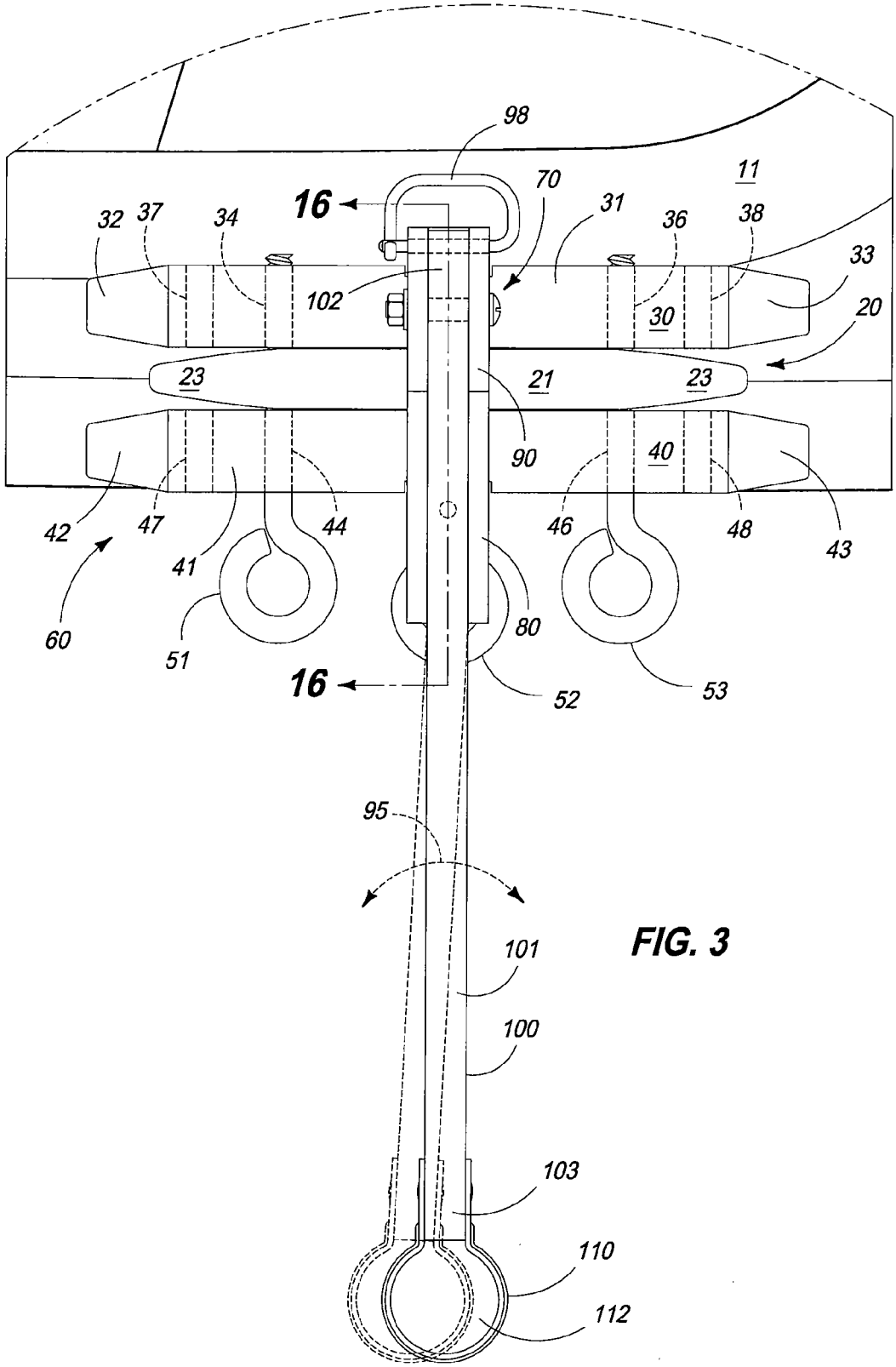
FIG. 3 is a greatly enlarged top plan view of the present invention.
Figure 4:
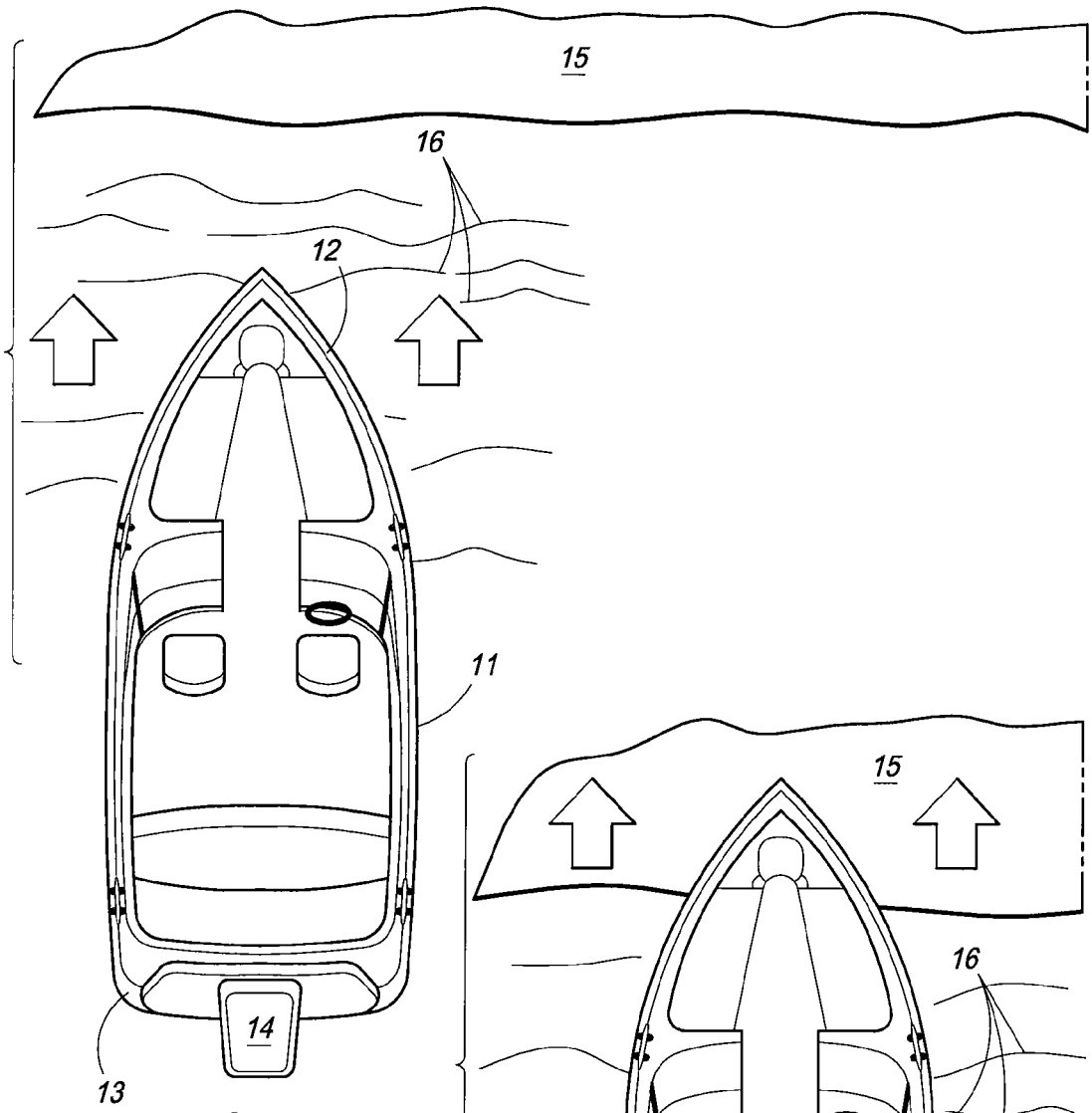
PRIOR ART FIG. 4
FIG. 4 is a depiction of a boat approaching a shoreline and prepared to be "beached."

A boat anchor for use on a boat or watercraft of conventional design is generally indicated by the numeral 10 in FIG. 1, and following.

Figure 5:
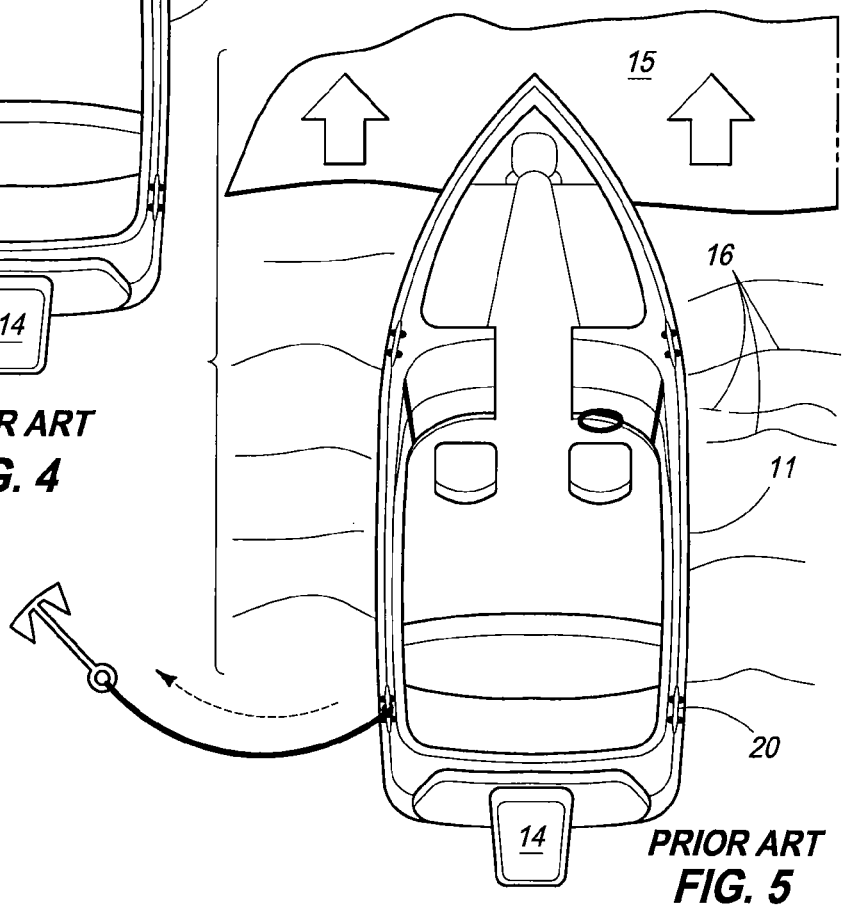
PRIOR ART FIG. 5
FIG. 5 depicts a typical way a boat has previously been secured once it has been "beached."
Figure 6:
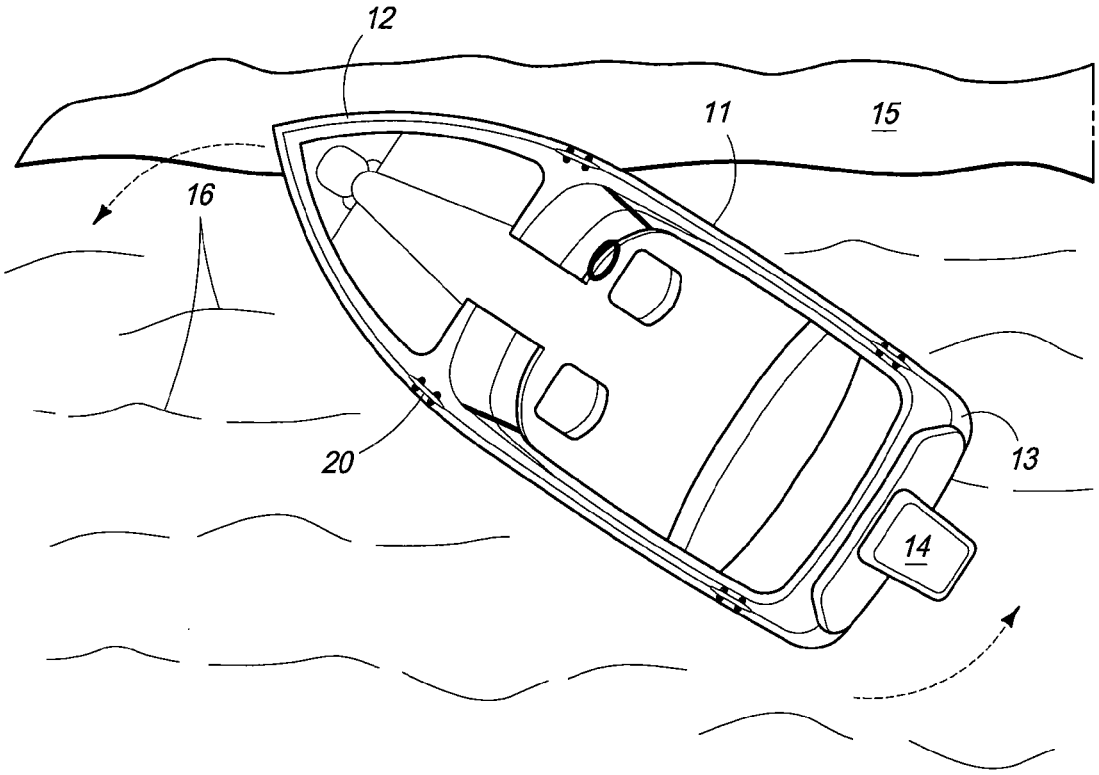
PRIOR ART FIG. 6
FIG. 6 depicts the usual movement of a boat relative to a breach under the influence of waves, or surf.
Figure 7:
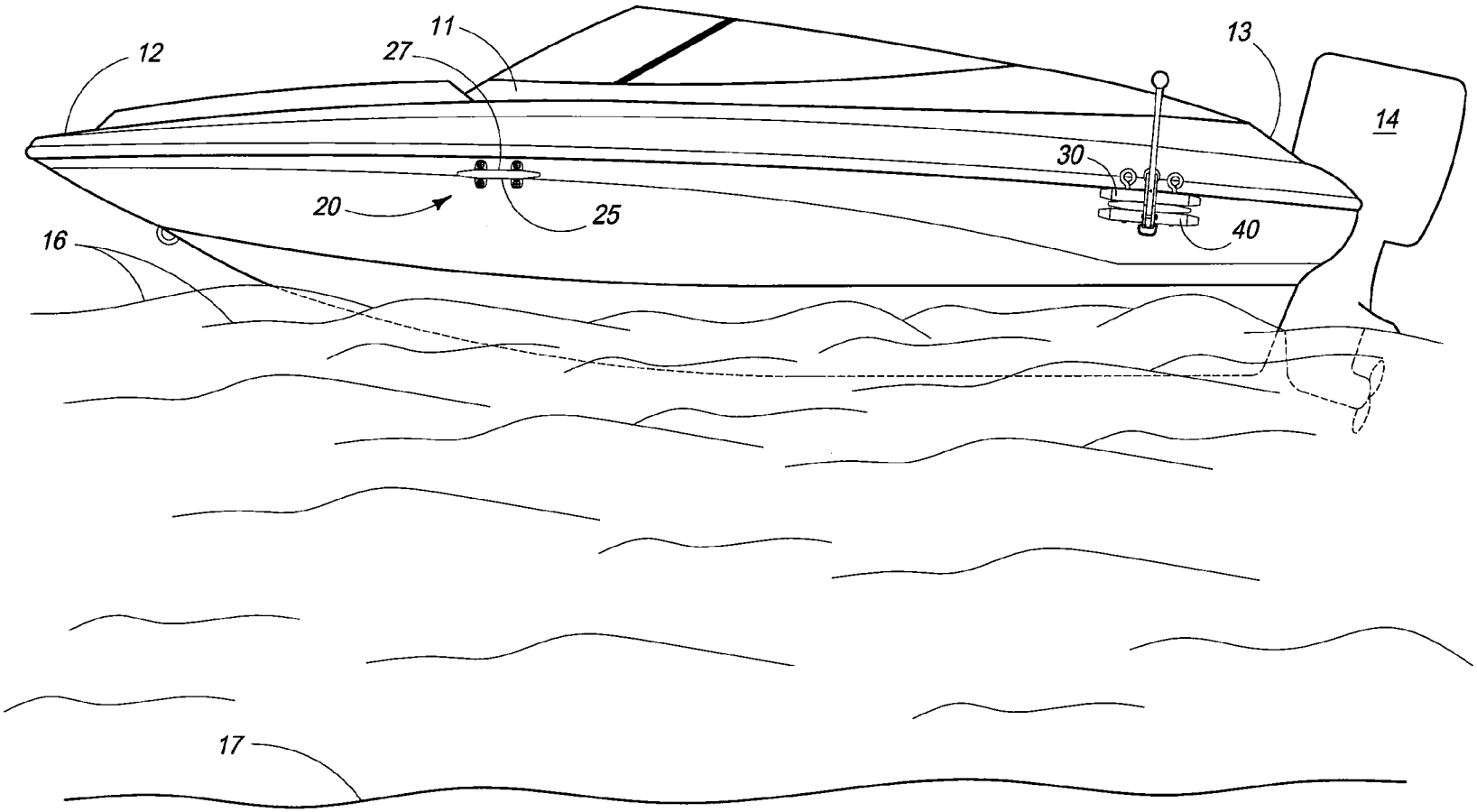
FIG. 7 depicts a side elevation view of the present invention mounted on a boat which is floating on a body of water and when the invention is not in use.

As seen in the drawings, the boat anchor 10 of the present invention is operable to be utilized on or in connection with a boat or watercraft 11 of conventional design. The boat has a forward or bow portion 12, and an opposite rear or stern portion 13. Further, the watercraft, as depicted, has a stern drive 14 which is used to propel the boat 11. As depicted in FIGS. 5 and 6, the boat 11 is shown in an orientation where it has been driven up onto a beach 15, which is adjacent to a body of water 16. Still further, as depicted, the stern 13 of the boat 11 is located in a floating, overlying relationship relative to an underwater surface which is generally indicated by the numeral 17. (FIG. 7) As will be understood, and periodically, the movement of the body of water 16 will tend to cause the stern 13 of the boat 11 to move upwardly and downwardly as waves, or other surf, moves towards the beach 15 where the boat 11 has been temporarily "beached." (FIG. 6)

Figure 8A:
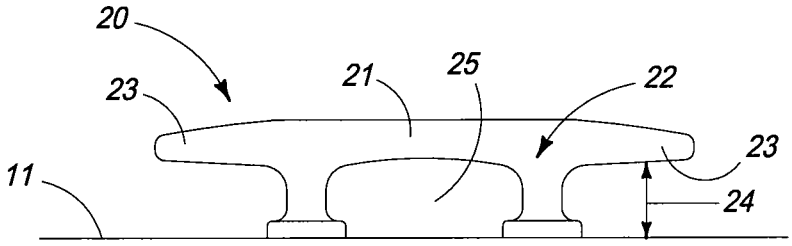
FIGS. 8A and 8B show a side elevation view, and a top plan view of a prior art cleat which is secured on a boat of conventional design.
Figure 8B:
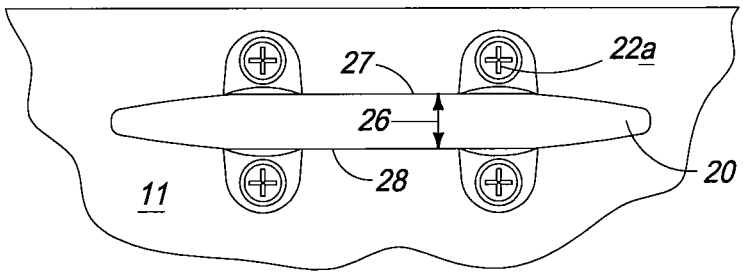

The boat anchor of the present invention 10 is operable to be releasably affixed to a cleat 20, which is of conventional design and which is attached to the boat 11. Such marine or rope securing cleats are well known and have been used for centuries. The cleat 20 has a main body 21, which is defined, in part, by a central region 22 which is affixed to the underlying boat 11 using threaded fasteners 22(*a*). Further, the cleat has individual longitudinally oriented and opposed cleat wings 23, which extend laterally outwardly and longitudinally relative to the central region 22, and which are further located in a spaced relationship relative to the underlying boat 11. A space 24 is defined between the boat 11, and the overlying, cleat wings 23. Further as illustrated in FIG. 8A, a passageway 25 of predetermined dimensions, is formed through the central region 22. Additionally, as seen in FIG. 8B, the cleat 20 has a given width dimension 26. It will be recognized from the discussion, as found in the paragraphs, below, that the present boat anchor 10 provides a convenient means whereby it may be successfully utilized with cleats 20 having various width dimensions 26, thereby allowing the anchor 10, to be utilized on a wide variety of different boats and/or other watercraft. The cleat 20 has opposite first and second surfaces which are generally indicated by the numerals 27 and 28, respectively.

Figure 9:
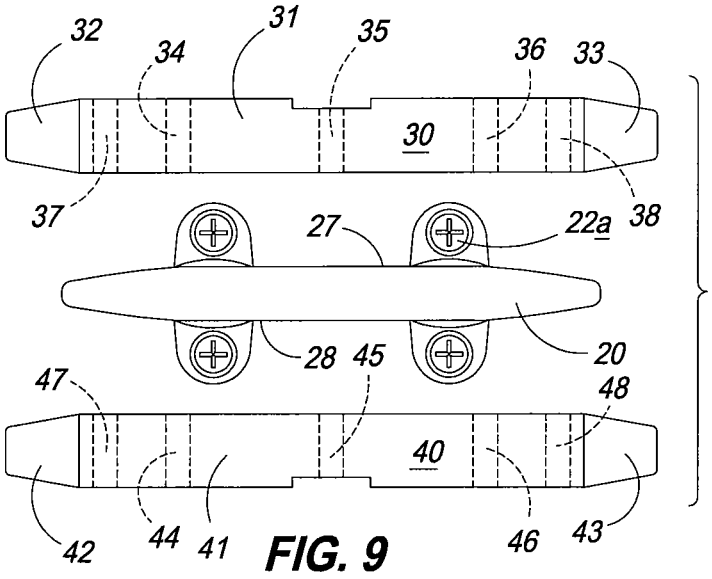
FIG. 9 is a fragmentary, exploded view of one feature of the present invention.
Figure 10:
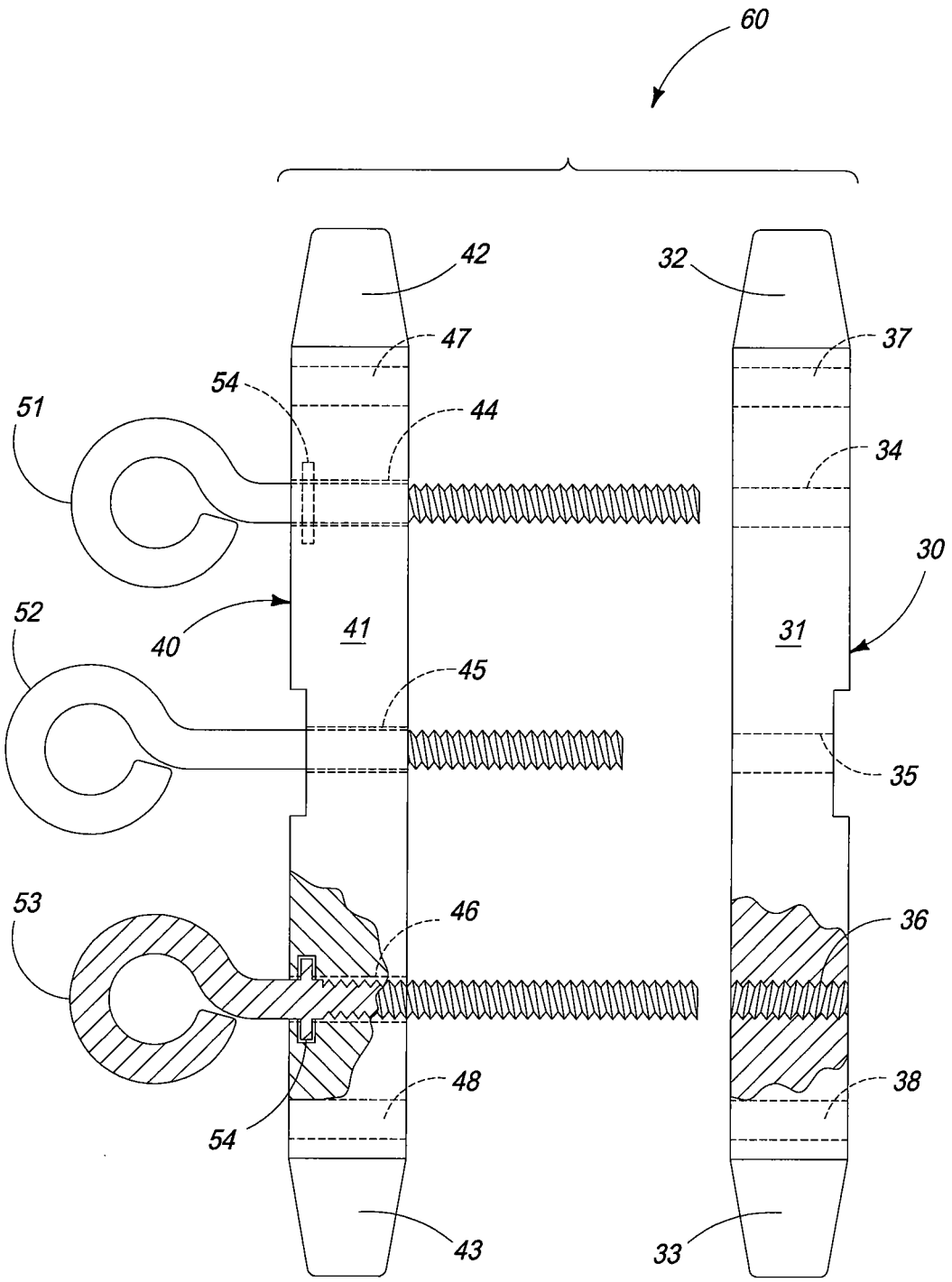
FIG. 10 is a greatly enlarged, side elevation view of one feature of the present invention.

As illustrated in FIGS. 9 and 10, the boat anchor 10 includes a first elongated support member which is defined by a main body 31, and which has a first end 32, and an opposite second end 33. The first elongated support member 30 is juxtaposed relative to the first surface 27 of the cleat 20. First, second and third apertures 34, 35 and 36 are formed in, and located in predetermined spaced relation, one relative to the other in the main body 31. Still further, the second aperture 35 is substantially coaxially aligned with the passageway 25, which is formed in the central region 22 of the cleat 20. (FIG. 1) Additional Apertures 37 and 38 may be provided and which will allow this structure to be used on cleats 20 which have varying length dimensions.

The boat anchor 10 of the present invention includes a second elongated support member which is generally indicated by the numeral 40. Similar to the first elongated support member 30, the second elongated member has a main body 41 that has opposite first and second ends 42 and 43, respectively. As illustrated in FIG. 10, the first and second elongated support members have substantially similar longitudinal as well as transverse dimensions. The second elongated support member has first, second and third apertures 44, 45, and 46, respectively that are formed therein, and which are located in predetermined spaced relation, one relative to the other, and which further can be substantially coaxially aligned relative to the first, second and third apertures 34, 35 and 36, respectively, and which were formed or defined in the first elongated support member 30. It should be understood, that the apertures, as formed in the respective first and second elongated support members 40, may be suitably threaded (as depicted) so as to receive a suitable fastener which will be discussed in the paragraphs which follow. As will be appreciated, the second aperture 45 of the second elongated support member 40 is substantially coaxially aligned with the second aperture 35 of the first elongated support member, and with the passageway 25 as defined by the central region 22 of the cleat 20. (FIG. 1) Similarly in this structure additional apertures 47 and 48 may be provided and used for the same purposes as stated in the paragraph, above.

As seen in FIG. 10, the boat anchor 10 further provides first, second and third fasteners 51, 52 and 53, respectively, and which are received through and matingly cooperate with the coaxial aligned first, second and third aperture 34 and 44; 35 and 45; and 36 and 46, respectively, and which are formed in the respective first and second elongated support members 30 and 40, respectively. As will be recognized, apertures 37 and 38 are aligned with apertures 47 and 48. As should be understood, the second fastener 52 is received through the passageway 25 formed in the central region 22 of the cleat 20. The respective fasteners 51, 52 and 53 releasably secure the first and second elongated support members in juxtaposed relationship relative to the cleat 20. As will be recognized from the drawings, the first and third fasteners 51 and 53, respectively, individually pass through the space 24, which is defined between the opposed cleat wings 23, and the underlying boat 11. The first and third fasteners are located on the opposite sides of the central region 22 of the cleat 20. The first and second elongated support members 30 and 40, and the first, second and third fasteners 51, 52 and 53, comprise, at least in part, a fixture 60, which is releasably secured to the cleat 20 that is mounted on the boat 11. As seen in FIG. 10, the fasteners may be fabricated in a fashion to include a flange 54 which prevents the fasteners from being separated from the second elongated support member 40. This prevents the loss of the fasteners while the invention is in storage; or due to loss when they are carelessly lost, overboard, when the invention is being installed, or removed from the cleat 20. Still further, and while the fasteners are depicted as having a circular proximal end, other designs, such as wings and toggles, may be used and which allow a user to effectively apply a rational force to the respective fasteners.

The boat anchor 20 includes an adjustable mounting assembly, which is generally indicated by the numeral 70 (FIG. 11), and which further includes a first and second member 71 and 72, respectively. The first member 71 of the adjustable mounting assembly 70 has a main body 73, which has a proximal end 74, which is releasably secured to the first elongated support member 30 by the second fastener 52. Still further, the main body 73 has a second, or distal end 75, which extends laterally outwardly relative to the first elongated support member 30, and away from the cleat 20. Still further as seen in the drawings, the first member includes an indexing member 76, which extends substantially longitudinally, outwardly, relative to the distal end 25 of the first member 71 and which substantially cooperates with the second member 72, as will be described in greater detail, below.

The boat anchor has, as earlier noted, an adjustable mounting assembly which includes a second member 72, and which has a main body 80, which cooperates with the first member 71, as described in the paragraph, immediately above. The main body 80 of the second member 72 has a proximal and a distal end 81, and 82 respectively. The proximal end 81 is releasably affixed to the second elongated support member 40 by the second fastener 52. The main body 80 of the second member 72 is further defined by a first leg 83, which extends laterally outwardly relative to the second elongated member 40, and which is oriented substantially parallel relative to the first member 71 of the adjustable mounting assembly 70. As will be recognized, the length dimension of the first leg 83 is substantially equal to the length dimension of the main body 73, of the first member 71. Still further, the main body 80 has a second leg 84, which is substantially perpendicularly oriented relative to the first leg 83. As will be recognized from FIG. 11, a multiplicity of apertures 85 are formed in a longitudinally extending pattern along the second leg 84, and which are individually dimensioned to receive the indexing member 76 therein. The arrangement, as seen in the drawings, and specifically the spaced apart multiplicity of apertures 85, provides a convenient means whereby the fixture 60 can be adjusted and then utilized on cleats 20 having different width dimensions 26. Therefore, the present invention can be used on a multiplicity of differently designed watercraft in a manner that has not been possible, heretofore.

Figure 11:
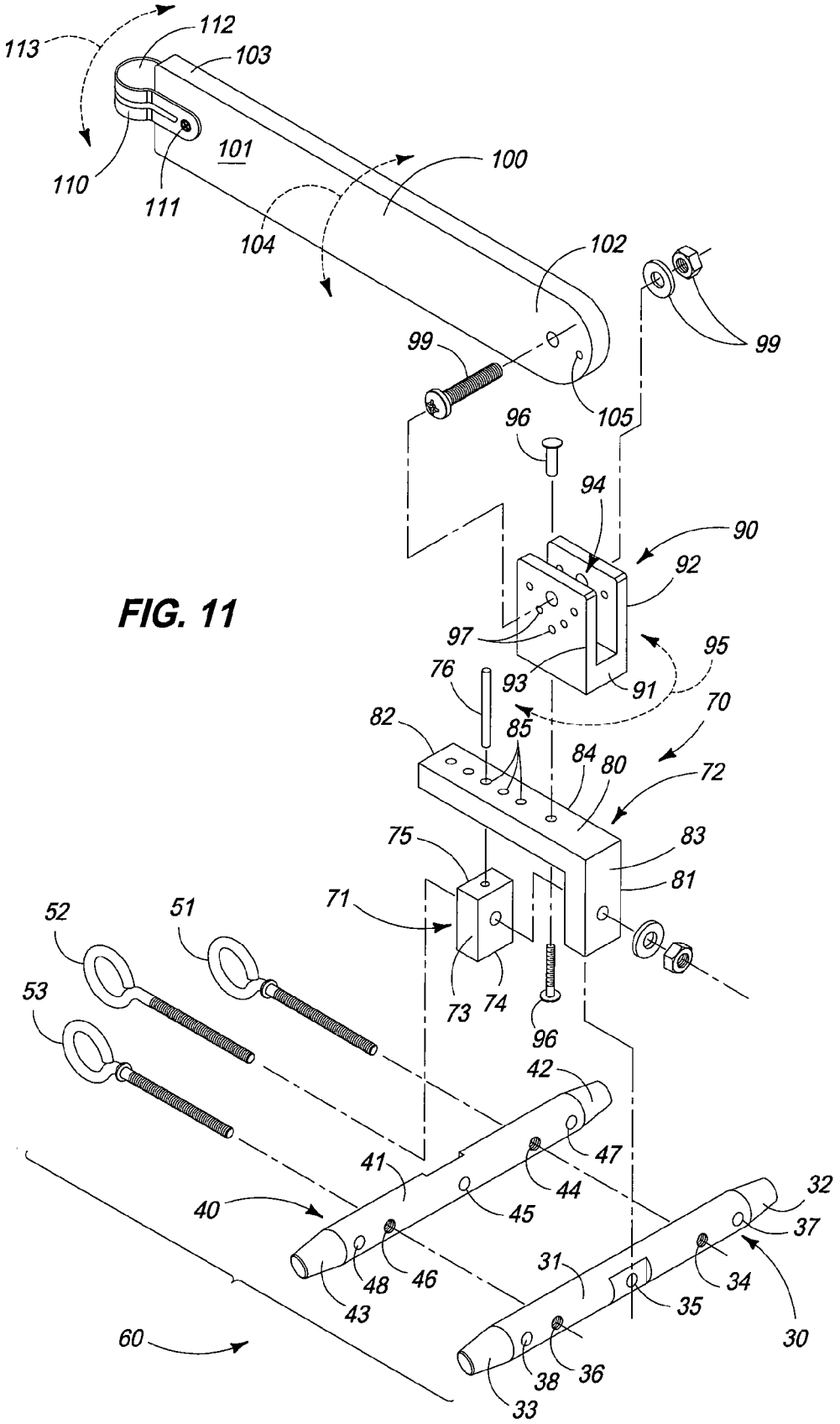
FIG. 11 is perspective, exploded view of a portion of the boat anchor of the present invention.
Figure 12B:
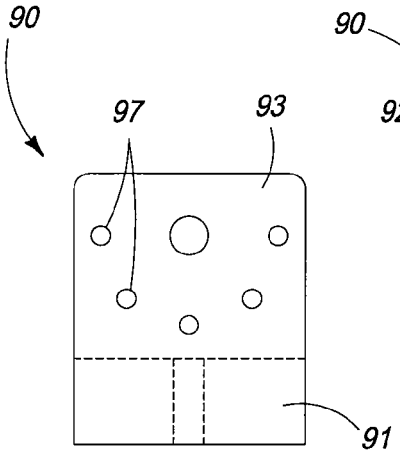
FIGS. 12A, B, C respectively depict a side elevation; transverse vertical sectional; and top plan views of a U-shaped attachment member which forms one feature of the present invention.
Figure 12A:
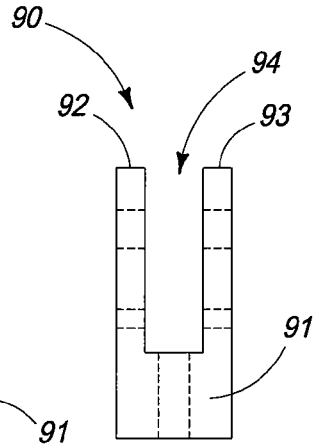
Figure 12C:
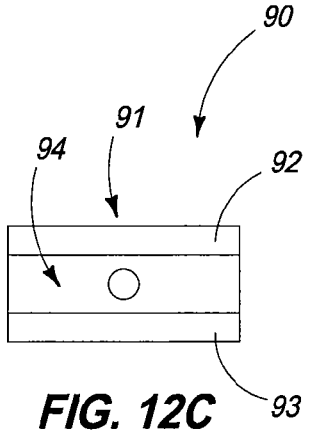
Figure 13A:
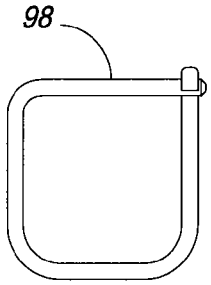
FIGS. 13A and B depict a setting pin in a closed, and open position, and which is a feature of the present invention.
Figure 13B:
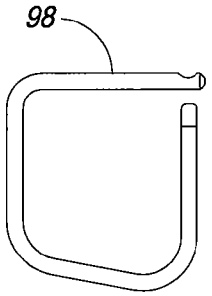
Figure 14A:
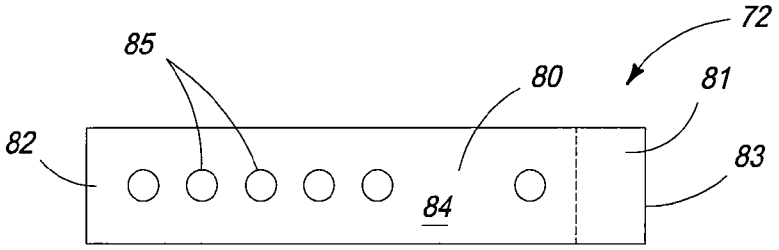
FIGS. 14A and B depict a side elevation view, and a transverse vertical sectional view of a portion of an adjustable mounting assembly which forms a feature of the present invention.
Figure 14B:
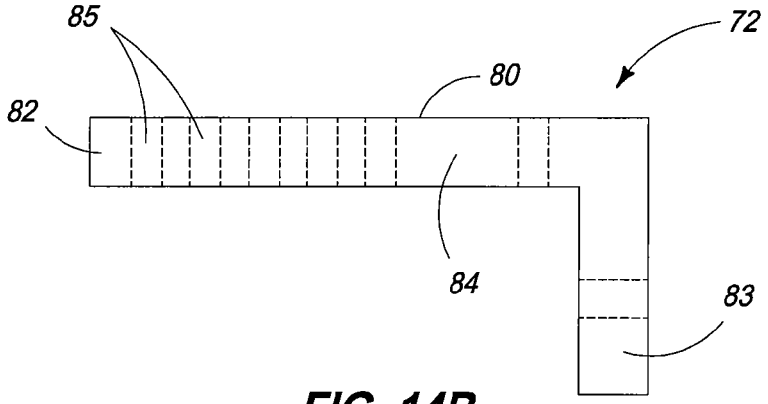
Figure 15A:
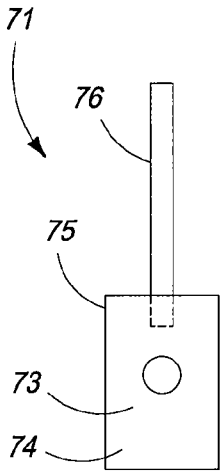
FIGS. 15A and B depict a side elevation view, and a transverse vertical sectional view of a portion of an adjustable mounting assembly which forms a feature of the present invention.
Figure 15B:
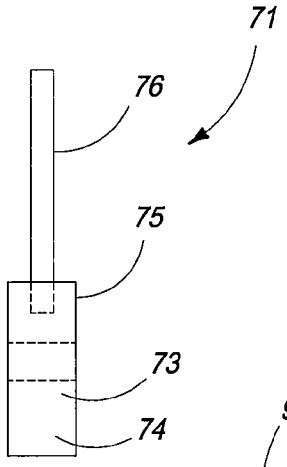
Figure 16:
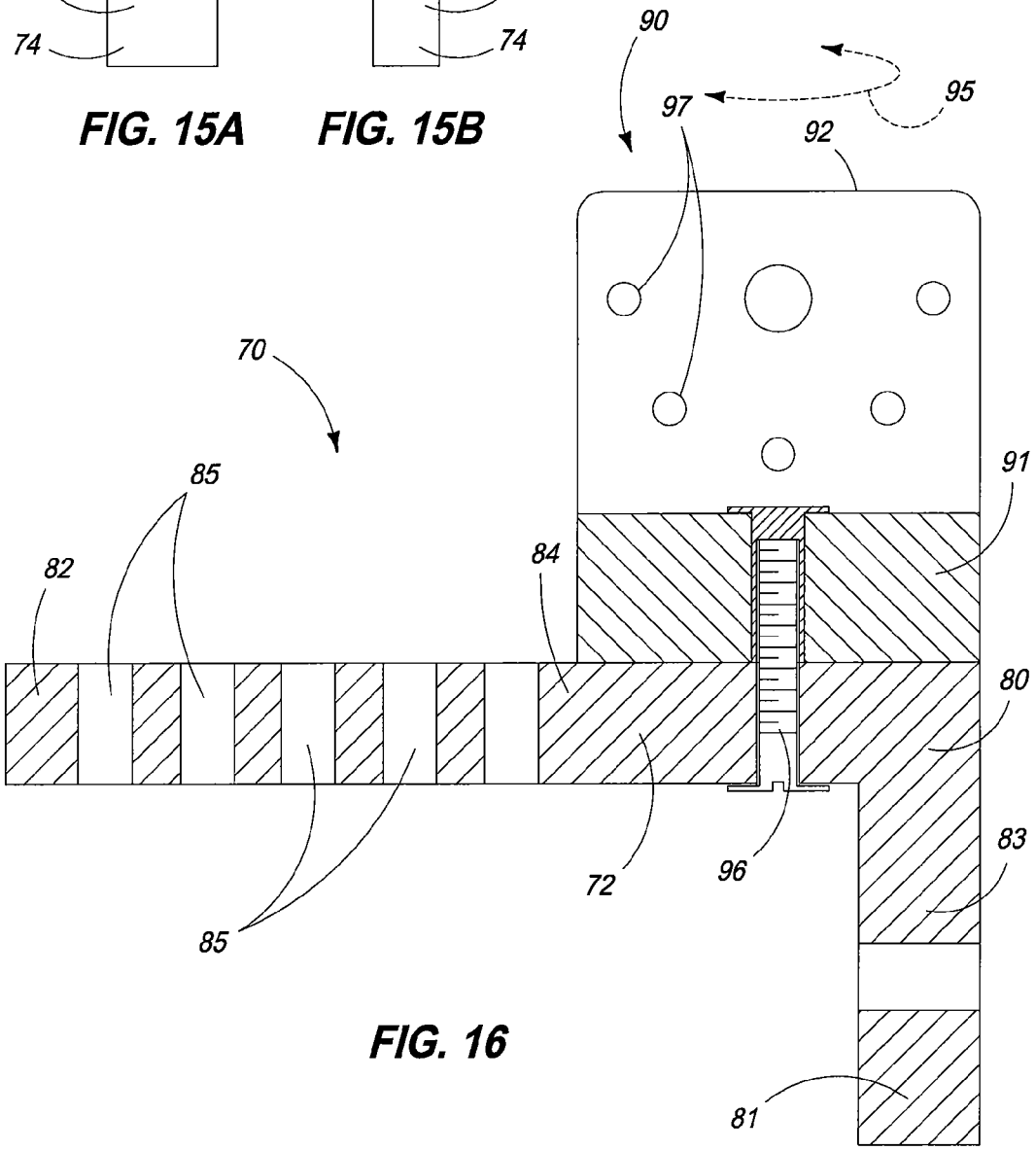
FIG. 16 is a transverse, vertical sectional view of a feature of the present invention.
Figure 17:
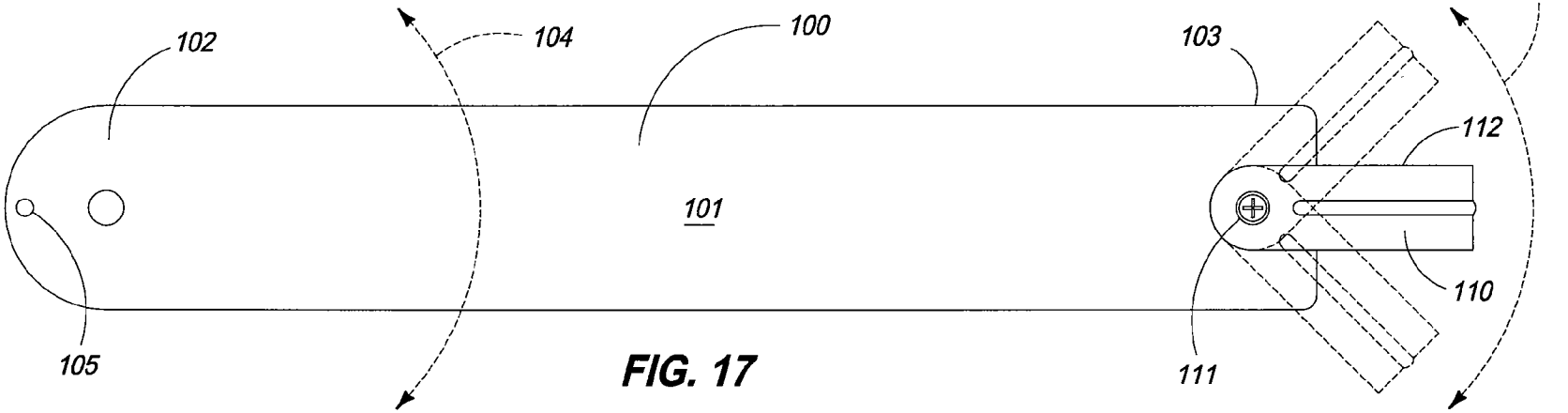
FIG. 17 is a side elevation view of an adjustable elongated arm which forms a feature of the present invention.
Figure 18:
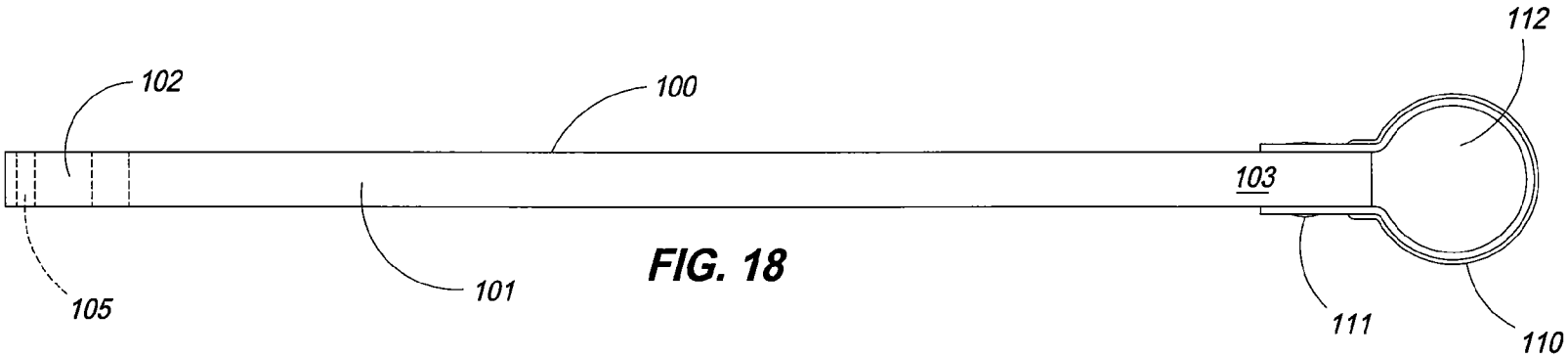
FIG. 18 is a top plan view of an adjustable elongated arm which forms a feature of the present invention.

The boat anchor 10 further includes a U-shaped attachment member which is generally indicated by the numeral 90. (FIG. 11) The U-shaped attachment member has a main body 91, which is rotatably attached to the second member 72 of the adjustable mounting assembly 70. The main body 91 has a pair of spaced legs, here indicated as a first leg 92, and a second leg 93, which are located in predetermined, substantially parallel spaced relation, one relative to the other, and which further extend normally, outwardly, relative to the second leg 84, of the second member 72. As seen in FIG. 11, the main body 91 is rotatably moveable along the path of travel which is generally indicated by the numeral 95. Still further, a fastener 96 is provided and which extends through main body 91 and which facilitates the rotation for the main body 91. Moreover, and as seen in the drawings, a multiplicity of apertures 97 are formed in a semi-circular pattern around a second fastener 99 which extends through the legs 92 and 93 respectively. The fastener 99 permits an adjustable arm to rotate relative thereto. The adjustable arm will be discussed in the paragraphs which follow. The aforementioned apertures 97, which are substantially coaxially aligned in each of the respective first and second legs 92 and 93, are operable to receive a setting pin 98 therethrough. (FIG. 1) The setting pin 98 is operable to physically cooperate with the rotatably moveable adjustable arm, as will be described, hereinafter, so as to positionally, angularly fix the orientation of the adjustable arm member, as will be described, relative to the fixture 60.

The boat anchor 10 of the present invention includes an adjustable elongated arm 100, which has a main body 101, and which further has a first or proximal end 102, which is received between, and is rotatably secured to the spaced legs 92 and 93 of the U-shaped attachment member 90. The adjustable arm 100, as discussed in the paragraph above, is selectively, angularly adjustable relative to the U-shaped attachment member 90. As seen in the drawings, the adjustable elongated arm 100 has a given length dimension which is typically greater than about one foot. Still further, and as seen in the drawings, the adjustable elongated member is moveable along a path of movement 104 relative to the U-shaped attachment member 90. Moreover, and illustrated in the drawings, at least one aperture 105 is formed in the main body 101 and which can be selectively coaxially aligned with one of the apertures 97. In this coaxially aligned orientation, the setting pin 98 may be received through the coaxially aligned apertures thereby providing a convenient way by which the adjustable elongated arm 100 may be fixedly, angularly secured in a predetermined orientation relative to the fixture 60. (FIG. 1) Further, it is possible that the setting pin 98 may not be used, thereby allowing the adjustable elongated arm 100 to rotate freely relative to the U-shaped attachment member 90, and along the path of travel 104. Still further, it will be recognized that the adjustable elongated arm may rotate about its longitudinal axis when the main body 91 of the U-shaped attachment member rotates relative to the second member 72 of the adjustable mounting assembly 70. Still further it will be recognized from the drawings that the elongated arm may be fabricated from a flexible substrate and which will prevent excessive torque from being applied to the cleat 20 when the boat 11 moves in response to repeated wave action striking the boat.

The boat anchor 10 of the present invention includes a rotatable channel member 110, which is mounted on the distal end 103 of the adjustable arm 100. The rotatable channel member defines a passageway 112 extending therethrough. As seen in the drawings, the rotatable channel member is rotatable about a path of travel 113 which is defined by a fastener 111, and which is used to attach the rotatable channel member to the distal end 103 of the adjustable elongated arm.

The boat anchor 10 of the present invention includes an elongated anchor rod which is generally indicated by the numeral 120. The anchor rod has a main body 121, which has a first or proximal end 122; and a second, or distal end 123, which is operable to engage the underwater surface 17, which is located near the boat 11. In the present invention 10 the adjustable elongated arm 100 maintains the boat 11 at a predetermined distance from the elongated anchor rod 120, as will be described in greater detail, below. More specifically, the elongated anchor rod, in addition to the proximal and distal ends 122 and 123, has opposite sides 124. The distal end 123, as noted, is operable to engage the underwater surface 17. As such, the distal end may, in one form of the invention, be ground, shaped, or otherwise formed into a point thereby allowing easier penetration into the underwater surface 12. Still further, force applied by a user (not shown) to the proximal end 122 is effective in driving the elongated anchor rod 120 to a given distance into the underlying underwater surface 17 in order to provide a secure placement for the elongated anchor rod 120. As seen in the drawings, the main body 121 of the elongated anchor rod 120 is received in the passageway 112 as defined by the rotatable channel member 110, and moves substantially freely through the passageway as defined by the rotatable channel member as the boat 11 moves upwardly and downwardly in response to a movement of the body of water 16 upon which the boat 11 is floating. This water movement is occasioned by waves or other surf that may move across the body of water and then land on the accompanying beach 15.

Figure 19:
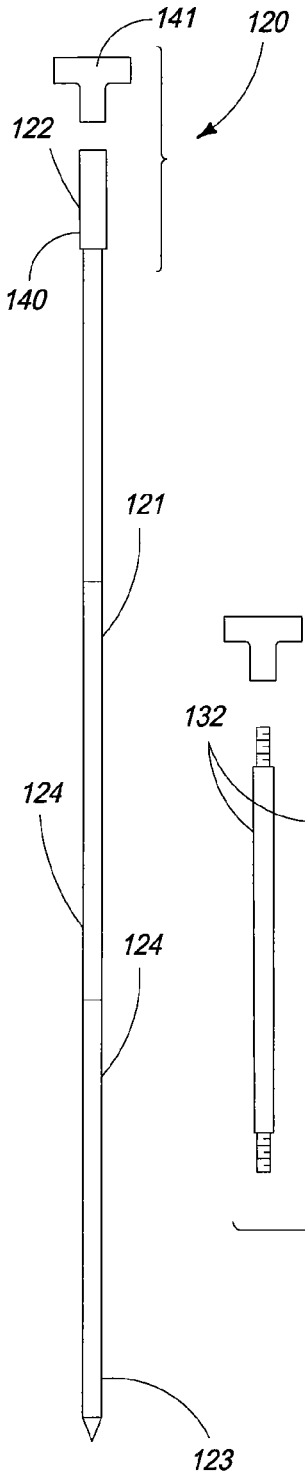
FIG. 19 is a side elevation view of a first form of an anchor rod which forms a feature of the present invention.
Figure 20:
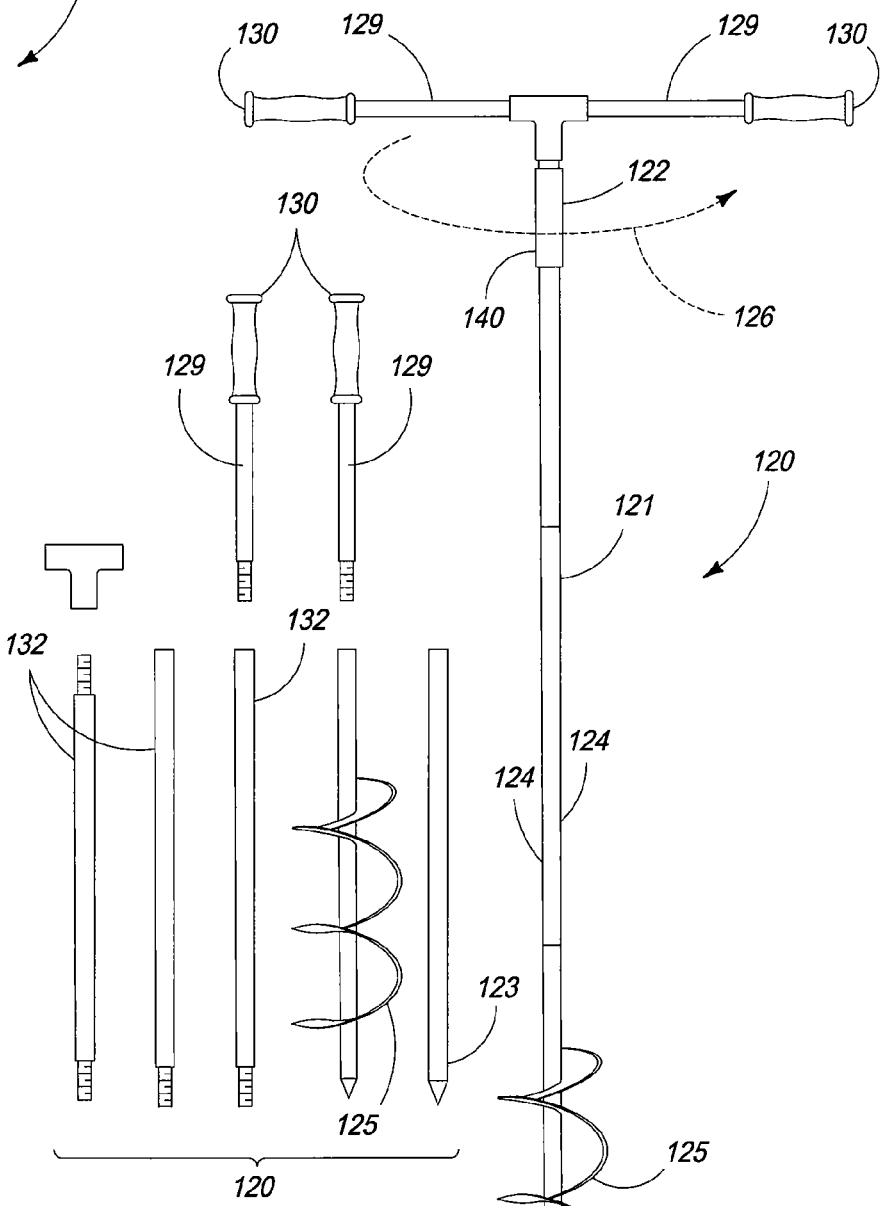
FIG. 20 is a side elevation view of a disassembled second form of an anchor rod which is a feature of the present invention.
Figure 21:
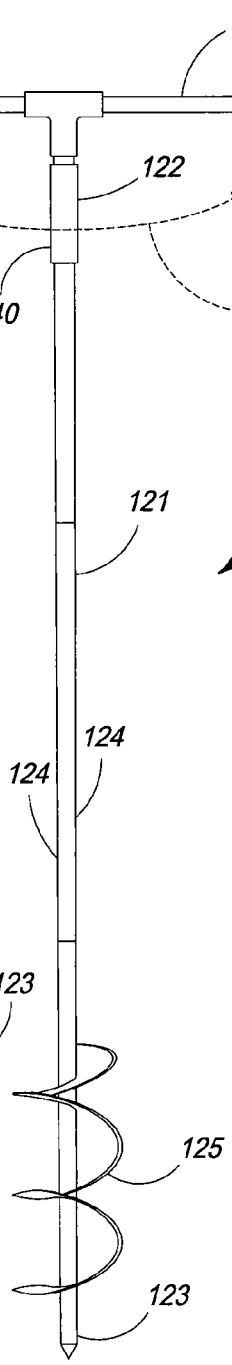
FIG. 21 is a side elevation view of an assembled anchor rod which forms a feature of the present invention.
Figure 22:
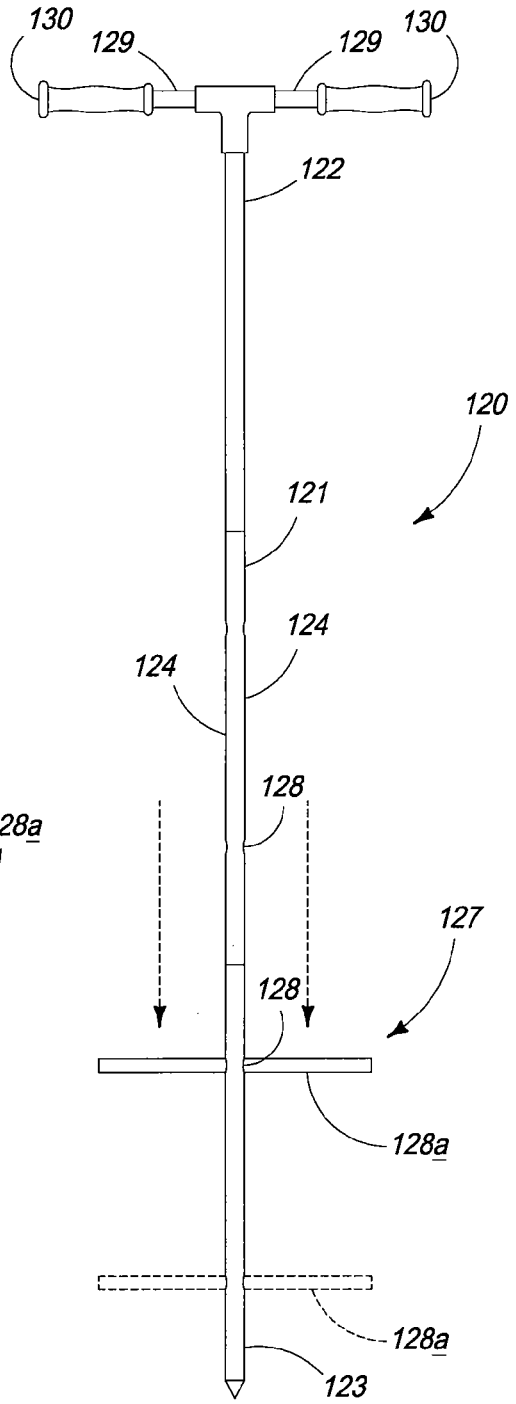
FIG. 22 is a side elevation view of yet another form of the anchor rod of the present invention.

As will be recognized, in this arrangement, the adjustable elongated arm 100 functions to maintain the boat 11 at a predetermined distance from the elongated anchor rod 120, however the elongated arm 100 freely moves up and down the elongated anchor rod 120 to accommodate the movement of the boat. In this arrangement, the stern 14 of the boat 11 remains in a substantially fixed orientation relative to the beach 15, and cannot turn in either direction so as to assume a parallel orientation. This invention prevents the boat 11 from damaging adjacent boats or further damaging the stern drive 14, as might be occasioned when the boat 11 turns sideways and pulls the stern drive across the underwater surface 17. (FIG. 6) As seen in the drawings, the elongated anchor rod 120 may have several forms including a unitary construction (FIG. 19), and wherein force may be applied to the proximal end 122 to drive the distal end 123 into the underwater surface 17. Still further, in an alternative form as seen in FIGS. 20 and 21, the distal end 123 of the anchor rod 120 has an auger-like shape 125, and wherein a substantially longitudinal rotation 126 of the elongated anchor rod 120 causes the distal end 123 of the anchor rod 120 to penetrate the underwater surface 17. In another possible form of the invention (FIG. 22), the anchor rod 120 further includes a foot member which is generally indicated by the numeral 127, and which is located between the proximal and distal ends 122 and 123 of the anchor rod 120. The foot member 127 extends perpendicularly, outwardly relative to the main body 121, and on the opposite sides 124 thereof. In this arrangement a user may place their feet, not shown, on the foot member 127, and force the distal end 123 of the anchor rod 120 into the underlying surface 17. In the arrangement as seen in the drawings, this foot member may be effected by an aperture 128, which extends transversely through the main body 121, and which accommodates a rod, or a cross piece 128A. This rod or cross piece 128A can, of course, be later removed and conveniently stored. It is also conceivable that folding steps, which are pivotally attached to the main body 121 (not shown) can be fabricated and which will provide a convenient, easy, elongated anchor rod 120 for convenient storage when not in use.

Figure 23:
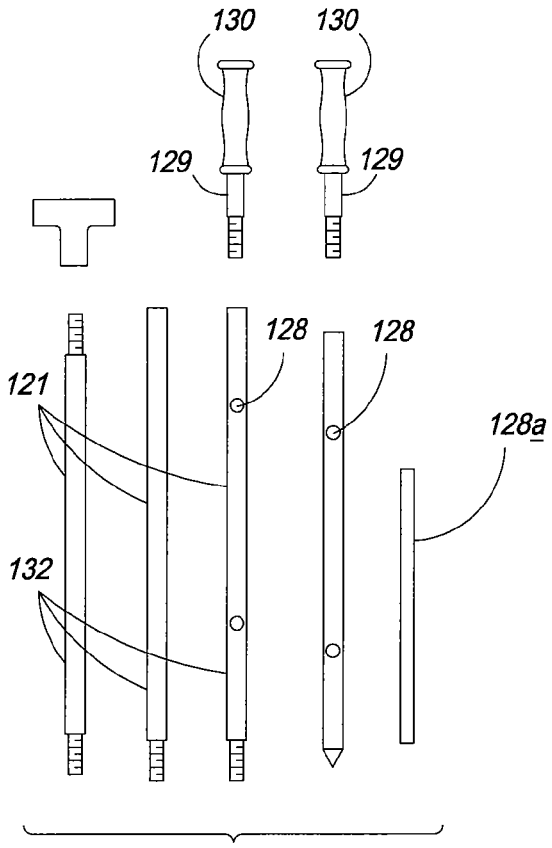
FIG. 23 is a side elevation view of the disassembled anchor rod as depicted in FIG. 22.

Therefore, the foot member 127, as described, may be readily detached from the main body 121 for storage. Still further, and relative to the elongated anchor rod 120 which shows the auger shaped end 125, this particular elongated anchor rod 120 may include a force transmitting member 129, which is coupled to the main body 121 of the anchor rod 120. The force transmitting member 129 is located near the proximal end 122 thereof, and which extends substantially transversely, laterally outwardly relative to the main body 121. The force transmitting member has a distal end 130, and wherein force applied by user, not shown, to the distal end 130 of the force transmitting member 129, imparts longitudinal rotational movement of the anchor rod along its longitudinal axis to facilitate the penetration of the distal end 123 into the underwater surface. Again, the force transmitting member 129 may be provided in a convenient form whereby it may be easily removed for storage when the elongated anchor rod 120 is no longer in use. It should be understood, that while the elongated anchor rod 120 may be formed in a unitary construction (FIG. 19), it is conceivable that the elongated anchor rod may be formed in multiple portions or sections 132 (FIGS. 20 and 23) which may be screwthreadably or otherwise fastened together. This arrangement will provide a convenient means whereby the elongated anchor rod 120 may be broken up or disassembled into shorter segments and then stored in a convenient storage bag or the like, in a compartment or other area of the watercraft 11 when it is not in use. Additionally, the anchor rod may be provided with a highly reflective fluorescent surface 140, which is located near the proximal end 122. This reflective surface would permit a user to easily locate the anchor rod 120 during reduced periods of visibility, such as at night. Further, and optionally, a resilient deformable surface or cap 141 may be provided and which mates with the proximal end of the anchor rod. Again this cap may be fabricated with a fluorescent surface so as to make it easier to locate it during reduced visibility. However, it would be fabricated of a flexible substrate so as to prevent harm to a boat passing nearby, or a swimmer, for example, moving from the beach into the body of water. Moreover, this cap 141 would prevent injury to a user in the event they slipped over the side of the boat and into the adjacent water.

OPERATION

The operation of the described embodiments of the present invention are believed to be readily apparent, and are briefly summarized at this point. In its broadest aspect, the present invention relates to boat anchor 10, which includes a fixture 60, and which is releasably secured to a cleat 20. The cleat 20 is mounted on a boat 11. In the arrangement as seen in the drawings, an adjustable arm 100 is movably mounted to the fixture 60, and further has a distal end 103. In the arrangement as shown, a channel member 110 is mounted on the distal end 103 of the adjustable arm 100, and which defines a passageway 112 extending therethrough. The present invention includes an elongated anchor rod 120, which is received an the passageway 112, and which further has a distal end 123, which is effective in engaging and penetrating an underwater surface 17, which is located near the boat 11. The adjustable arm maintains the boat 11 at a predetermined distance from the anchor rod 120, and the adjustable arm member is readily slideably moveable therealong the elongated anchor rod 120 as the boat 11 moves upwardly and downwardly on the body of water 16 on which it is floating.

The adjustable arm 100 may be fabricated of either a rigid, substantially inflexible substrate or a rigid flexible substrate which would accommodate some bending of the adjustable arm about its longitudinal axis. This bending would reduce to some degree any excess torque being imparted to the cleat 20. Moreover, the anchor rod 120 has a length dimension of greater than about 3 feet. typically, the length of the anchor rod will be selected so as to permit free movement of the adjustable arm along the anchor rod, but would prevent the adjustable arm from sliding up and off of the anchor rod and thereby permitting the boat to move near, or even over the top of the anchor rod. In this situation, damage to the hull of boat 11 could result.

Therefore, it will be seen that the present invention provides a convenient means whereby a boating enthusiast may avail themselves of easily beaching their watercraft on an adjacent sandy beach and thereby secure either the bow, or the stern from movement relative to the beach so as to prevent the boat 11 from damaging adjacent boats or further turning sideways and parallel to the beach and potentially damaging a stern drive of the watercraft.

In compliance with the statute, the present invention has been described in language more or less specific as to structural and methodical features. It should be understood, however, that the invention is not limited to the specific features shown and described since the means herein disclosed comprise preferred forms of putting the invention into effect. The invention is, therefore, claimed in any of its forms or modifications within the proper scope of the pending claimed appropriately interpreted in accordance with the Doctrine of Equivalents.

I claim:

1. A boat anchor comprising:

a fixture which is releasably securable to a cleat that is mounted on a boat, and wherein the cleat has first and second, opposite facing surfaces, and a central region which is secured to the boat, and wherein the fixture has first and second support members which are individually juxtaposed relative to the respective first and second, opposite facing surfaces of the cleat, and wherein the respective first and second support members each have a pair of coaxially aligned fastener apertures formed therein, and wherein the fixture further includes individual threaded fasteners which are matingly, threadedly received in the coaxially aligned apertures, and which individually releasably secure the first and second support members to each other, and to the cleat;

an adjustable arm moveably mounted to the fixture, and which has a distal end;

a channel member mounted on the distal end of the adjustable arm, and which defines a passageway; and an elongated anchor rod which is received in the passageway, and which further has a distal end which is operable to engage and penetrate an underwater surface which is located near the boat, and wherein the adjustable arm maintains the boat at a predetermined distance from the anchor rod.

2. A boat anchor as claimed in claim 1, and further comprising:

an adjustable mounting assembly which is releasably affixed to each of the first and second support members, and wherein the adjustable mounting assembly includes a first member having opposite proximal and distal ends, and an indexing member which extends substantially longitudinally outwardly relative to the distal end thereof, and wherein the proximal end is releasably affixed to the first support member; and a second member having a proximal end which is releasably affixed to the second support member, and an opposite distal end which has a multiplicity of apertures formed therein, and wherein the indexing member is received in one of the apertures formed in the distal end.

3. A boat anchor as claimed in claim 2, and further comprising:

an attachment member having a main body with a first end which is rotatably secured on the second member of the adjustable mounting assembly, and a second end, and wherein the moveable arm has a proximal end which is selectively, rotatably attached to the second end of the attachment member.

4. A boat anchor as claimed in claim 3, and wherein the proximal end of the moveable arm can be rotatably fixed in a predetermined angular orientation relative to the second end of the attachment member.

5. A boat anchor as claimed in claim 4, and wherein the attachment member facilitates motion of the moveable arm in multiple axial planes.

6. A boat anchor as claimed in claim 1, and wherein the elongated anchor rod has a unitary construction, and further has a proximal end for receiving a force so as to drive the distal end thereof into the underwater surface, and wherein the distal end of the adjustable arm is movable substantially freely up and down the anchor rod.

7. A boat anchor as claimed in claim 1, and wherein the elongated anchor rod is formed of discrete portions which are releasably joined together to form the resulting elongated anchor rod, and wherein the distal end of the adjustable arm is movable substantially freely up and down the anchor rod.

8. A boat anchor as claimed in claim 1, and wherein the distal end of the anchor rod has an auger-like shape, and wherein substantially longitudinal rotation of the elongated anchor rod causes the distal end of the anchor rod to penetrate the underwater surface.

9. A boat anchor as claimed in claim 1, and wherein the anchor rod has a proximal end, and a main body which is defined between the proximal and distal ends, and wherein the main body has opposite sides, and wherein the anchor rod further includes a foot member which is located between the proximal and distal ends of the anchor rod, and which extends perpendicularly outwardly relative to the main body, and on the opposite sides thereof, and wherein a user may place their feet on the foot member and force the distal end of the anchor rod to penetrate into the underwater surface.

10. A boat anchor as claimed in claim 9, and wherein the foot member may be detached from the main body of the anchor rod for storage.

11. A boat anchor as claimed in claim 8, and further including a force transmitting member which is coupled to the main body of the anchor rod and which is located near the proximal end thereof, and wherein the force transmitting member extends substantially transversely, laterally outwardly relative to the main body, and which further has a distal end, and wherein force applied by a user to the distal end of the force transmitting member imparts longitudinal rotational movement to the anchor rod to facilitate penetration of the underwater surface.

12. A boat anchor as claimed in claim 1, and wherein the anchor rod has a length dimension of greater than about 3 feet.

13. A boat anchor as claimed in claim 1, and wherein channel member is rotatable relative to the distal end of the adjustable arm.

14. A boat anchor, comprising:

a cleat mounted on a boat, and wherein the cleat has a central region which is secured to the boat, and further has individual, substantially longitudinally oriented, and opposed cleat wings which extend laterally outwardly relative to the central region, and which are spaced a given distance from the boat, and wherein a passageway extends through the central region of the cleat, and wherein the cleat has opposite first and second surfaces;

a first elongated support member having first, second and third apertures formed therein, and which is juxtaposed relative to the first surface of the cleat, and wherein the second aperture is substantially coaxially aligned with the passageway formed in the central region of the cleat;

a second elongated support member having first, second and third apertures formed therein, and which is juxtaposed relative to the second surface of the cleat, and wherein the first, second and third apertures of the second elongated support member are substantially coaxially aligned relative to the first second and third apertures formed in the first elongated support member;

first, second and third fasteners which are individually received through the coaxially aligned first, second and third coaxially aligned apertures formed in the respective first and second elongated support members, and wherein the second fastener is received through the passageway formed in the central region of the cleat, and wherein the respective fasteners releasably secure the first and second elongated support members to the cleat;

a first member of an adjustable mounting assembly having a proximal end which is releasably secured to the first elongated support member by the second fastener, and which further has a second distal end which extends substantially laterally outwardly relative to the first elongated support member, and away from the cleat, and wherein an indexing member extends longitudinally outwardly relative to the distal end of the first member;

a second member of an adjustable mounting assembly having a main body which has a proximal end which is releasably affixed to the second elongated support member by the second fastener, and an opposite distal end, and wherein the main body of the second member has a first leg which extends laterally outwardly relative to the second elongated support member, and which is substantially parallel relative to the first member of the adjustable mounting assembly, and a second leg which is substantially perpendicular to the first leg, and wherein a multiplicity of apertures are formed in a given longitudinally extending pattern along the second leg and which are dimensioned to receive the indexing member therein;

a U-shaped attachment member having a main body which is rotatably attached to the second member of the adjustable mounting assembly, and wherein the main body has a pair of spaced legs which extend normally outwardly relative to the second leg of the second member;

an adjustable elongated arm having a proximal and a distal end, and wherein the proximal end is received between, and rotatably secured to, the spaced legs of the U-shaped attachment member, and wherein the adjustable arm is selectively, angularly adjustable relative to the U-shaped adjustment member, and wherein the adjustable arm is moveable in multiple axes;

a rotatable channel member mounted on the distal end of the adjustable arm, and which defines a passageway extending therethrough; and an elongated anchor rod having a main body with a proximal and a distal end, and which extends through the rotatable channel, and wherein the distal end is operable to engage an underwater surface which is located near the boat, and wherein the elongated anchor rod moves substantially freely though the passageway as defined by the rotatable channel member as the boat moves upwardly and downwardly in response to a movement of a body of water upon which the boat is floating, and wherein the adjustable arm maintains the boat at a predetermined distance from the anchor rod.

15. A boat anchor as claimed in claim 14, and wherein the first and third fasteners individually pass through the space defined between the opposed cleat wings and the boat, and on the opposite sides of the central region of the cleat.

16. A boat anchor as claimed in claim 14, and wherein the first member of the adjustable mounting assembly has a given length dimension, and wherein the first leg of the second member of the adjustable mounting assembly has a length dimension which is equal to that of the first member.

17. A boat anchor as claimed in claim 14, and wherein the adjustable arm has a length dimension of greater than about one foot, and the elongated anchor rod has a length dimension of greater than about 3 feet.

18. A boat anchor as claimed in claim 14, and wherein the elongated anchor rod has a unitary construction, and further has a proximal end, and wherein a force is applied to the proximal end to drive the distal end thereof into the underwater surface.

19. A boat anchor as claimed in claim 14, and wherein the elongated anchor rod is formed of discrete portions which are releasably joined together to form a resulting elongated anchor rod.

20. A boat anchor as claimed in claim 14, and wherein the distal end of the anchor rod has an auger-like shape, and wherein substantially longitudinal rotation of the elongated anchor rod causes the distal end of the anchor rod to penetrate the underwater surface.

21. A boat anchor as claimed in claim 14, and wherein the anchor rod has opposite sides, and wherein the anchor rod further includes a foot member which is located between the proximal and distal ends of the anchor rod, and which extends perpendicularly outwardly relative to main body, and on the opposite sides thereof, and wherein a user may place their feet on the foot member and force the distal end of the anchor rod into the underwater surface.

22. A boat anchor as claimed in claim 21, and wherein the foot member may be readily detached from the main body of the anchor rod for storage.

23. A boat anchor as claimed in claim 20, and further including a force transmitting member which is coupled to the main body of the anchor rod, and which is located near the proximal end thereof, and which extends substantially transversely, laterally outwardly relative to the main body, and which further has a distal end, and wherein force applied by a user to the distal end of the force transmitting member imparts longitudinal, rotational movement of the anchor rod to facilitate penetration of the underwater surface.

24. A boat anchor as claimed in claim 14, and wherein the adjustable elongated arm is flexible.

25. A boat anchor as claimed in claim 14, and where the proximal end of anchor rod has a reflective coating applied thereto.

26. A boat anchor as claimed in claim 14, and further including a resilient cap which matingly engages the proximal end of the anchor rod.

27. A boat anchor as claimed in claim 26, and where the resilient cap has a highly reflective coating.

* * * * *